US006700361B2

(12) United States Patent
Gregorius

(10) Patent No.: US 6,700,361 B2
(45) Date of Patent: Mar. 2, 2004

(54) VOLTAGE REGULATOR WITH A STABILIZATION CIRCUIT FOR GUARANTEEING STABILE OPERATION

(75) Inventor: Peter Gregorius, München (DE)

(73) Assignee: Infineon Technologies AG, Munich (DE)

( * ) Notice: Subject to any disclaimer, the term of this patent is extended or adjusted under 35 U.S.C. 154(b) by 26 days.

(21) Appl. No.: 10/131,375

(22) Filed: Apr. 24, 2002

(65) Prior Publication Data

US 2003/0011350 A1 Jan. 16, 2003

(30) Foreign Application Priority Data

Apr. 24, 2001 (DE) ..... 101 19 858

(51) Int. Cl.[7] ..... G05F 1/40
(52) U.S. Cl. ..... 323/282; 323/274; 323/275
(58) Field of Search ..... 323/273, 274, 323/275, 282, 284

(56) References Cited

U.S. PATENT DOCUMENTS

| | | | | |
|---|---|---|---|---|
| 5,182,525 A | | 1/1993 | Theus | 330/253 |
| 5,706,240 A | * | 1/1998 | Fiocchi et al. | 365/226 |
| 5,825,165 A | * | 10/1998 | Kitching et al. | 323/282 |
| 5,828,206 A | * | 10/1998 | Hosono et al. | 323/273 |
| 6,144,250 A | | 11/2000 | Owen et al. | 324/533 |
| 6,154,015 A | * | 11/2000 | Ichiba | 323/225 |
| 6,157,180 A | * | 12/2000 | Kuo | 323/282 |
| 6,249,112 B1 | * | 6/2001 | Khouri et al. | 323/282 |
| 6,265,856 B1 | * | 7/2001 | Cali' et al. | 323/273 |
| 6,300,749 B1 | * | 10/2001 | Castelli et al. | 323/273 |
| 6,310,467 B1 | * | 10/2001 | Sauer | 323/273 |
| 6,593,726 B1 | * | 7/2003 | Chevallier et al. | 323/284 |

FOREIGN PATENT DOCUMENTS

| | | |
|---|---|---|
| DE | 22 41 621 C3 | 3/1973 |
| DE | 39 27 278 A1 | 4/1990 |
| EP | 0 620 514 A2 | 10/1994 |
| EP | 1 081 835 A2 | 3/2001 |

OTHER PUBLICATIONS

Thomas M. Frederiksen: A Monolithic High–Power Series Voltage Regulator, *IEEE Journal of Solid–State Circuits, Dec. 1968*, pp. 380–387.

Gabriel A. Rincon–Mora et al.: "A Low–Voltage, Low Quiescent Current, Low Drop–Out Regulator", *IEEE Journal of Solid–State Circuits,* vol. 33, No. 1, Jan. 1998, pp. 36–44.

Gerrit W. den Besten et al.: Embedded 5 V–to–3.3 V Voltage Regulator for Supplying Digital IC's in 3.3 V CMOS Technology, *IEEE Journal of Solid–State Circuits,* vol. 33, No. 7, Jul. 1998, pp. 956–962.

* cited by examiner

*Primary Examiner*—Bao Q. Vu
(74) *Attorney, Agent, or Firm*—Laurence A. Greenberg; Werner H. Stemer; Ralph E. Locher

(57) ABSTRACT

A voltage regulator is described, the output voltage of which depends on a drive to a transistor contained in the voltage regulator. The voltage regulator described is distinguished by the fact that it contains a stabilization circuit that can change the current flowing through the transistor. Such a voltage regulator is simple to configure and to implement and, with minimum intrinsic power requirement, is stable under all circumstances.

17 Claims, 5 Drawing Sheets

VOLTAGE REGULATOR WITH A STABILIZATION CIRCUIT FOR GUARANTEEING STABILE OPERATION

BACKGROUND OF THE INVENTION

Field of the Invention

The present invention relates to a voltage regulator. The output voltage of which depends on the drive to a transistor contained in the voltage regulator.

A voltage regulator of this type is shown in FIG. 5.

The configuration shown in FIG. 5 contains a direct voltage regulator and a load impedance Zout connected thereto.

The voltage regulator contains a differential amplifier (a differential transconductance amplifier) OTA1, an NMOS transistor MN1, a first resistor Rfb, a second resistor Re, a third resistor Rs1, a first capacitor Cs1, a second capacitor Cs2, and a third capacitor Cs3.

The voltage regulator generates an output voltage Vout which is picked up at a source terminal of the transistor MN1 and which is supplied as a supply voltage to the load Zout. A supply voltage supplying the voltage regulator with power is applied to a drain terminal of the transistor MN1, and the gate terminal is connected to the output terminal of the transconductance amplifier OTA1. The transconductance amplifier OTA1 has two input terminals, one of which is supplied with an input voltage Vin and the other of which is supplied with a voltage depending on (fed back from) the output voltage Vout. The transconductance amplifier OTA1 forms the difference between the voltages and outputs the result to the gate terminal of the transistor MN1. The voltage fed back is picked up at a node x2 located between the resistors Rfb and Re. The resistors Rfb and Re are connected in series and are disposed between the source terminal of the transistor MN1 and ground.

FIG. 6 shows the small-signal equivalent circuit of the configuration shown in FIG. 5.

The voltage regulator described is a series voltage regulator with a common-drain NMOS transistor as a driver stage. It should be clear, and does not require further explanation, that the voltage regulator shown is capable of generating a constant output voltage Vout that depends only on Vin and the feedback factor (determined by the resistors Rfb and Re). However, this is not guaranteed under all circumstances, especially in the case of complex loads Zout, i.e. in the case of loads with inductive and/or capacitive components. The system may become unstable in this case.

The stability problems would not occur if it could be ensured, by suitable dimensioning of Rfb and Re, that the current Is1 flowing through the transistor MN1 does not drop below a certain minimum value even with a large Zout, that is to say a low load current, that is to say the transistor MN1 has a certain minimum transconductance (a certain minimum output conductance). However, providing a large (shunt) current flowing via the transistor MN1 and the resistors Rfb and Re is associated with various disadvantages. In particular, such a voltage regulator has a high intrinsic power requirement, and the transistor MN1 has to be configured to be larger than would be the case with a low shunt current. In addition, the minimum shunt current necessary for ensuring the stability is not available for driving the load Zout.

The dependence of the stability of the voltage regulator on the minimum shunt current is now explained.

In a simplified way, the configuration according to FIG. 5 can be understood to be a two-pole system. The stability criterion requires that the two poles are apart by a factor of at least n≧10.

The first pole fp1 is obtained in a simplified manner in accordance with equation 1.1.

$$f_{p1} \cong \frac{1}{2*\pi*C_{m1}*1/gm_{OTA1}} \tag{1.1}$$

It can be seen that the first dominant pole is determined by the transconductance gm of the transconductance amplifier OTA1 and by the stabilization capacitance Cm1. In practice, the first pole is invariant and is determined by the necessary bandwidth of the configuration.

The second pole is determined in a simplified manner by the load capacitance Cout at the output Vout, the load impedance Zout and the output conductance gds of the driving transistor MN1. Equation 1.2 reproduces the mathematical relationship for calculating the second pole.

$$f_{p2} \cong \frac{1}{2*\pi*C_{out}*(1/gds_{MN1}\|Zout\|(\mathrm{Re}+Rfb))} \tag{1.2}$$

Using the aforementioned simplified dimensioning rule, according to which fp2≧10*fp1 is to apply for a given load, the necessary minimum shunt current and thus the resistance value Rmin (the sum of resistors Re and Rfb) can be calculated.

The second pole fp2 is directly proportional to the output conductance of the driving transistor. The minimum output conductance of the transistor is directly proportional to the minimum shunt current Iq=Is1 set and thus ultimately to the minimum phase margin of the configuration.

As has already been explained above, these relationships are disadvantageous.

For this reason, alternatives for influencing the stability of voltage converters that do not have these disadvantages have long been sought.

One possibility for this consists in providing additional elements by which the transfer function of the system or, more precisely, the position of the pole positions and zero positions of the transfer function can be influenced in order to thus guarantee a minimum phase margin for stabilization purposes. In the case of the voltage regulator shown in FIG. 5, these possibilities have been used. The additional elements contain the resistor Rs and the capacitors Cs1, Cs2 and Cs3. Of the elements, resistor Rs and capacitor Cs1 are connected in series and disposed between the output terminal of the transconductance amplifier OTA1 and ground, the capacitor Cs2 is disposed between the feedback branch and ground, and the capacitor Cs3 is disposed in parallel with the resistor Rfb.

The elements make it possible to influence the position of the pole and zero positions of the transfer function and thus also the stability characteristic of the system. However, it is difficult and complex and in some cases even impossible to dimension the elements in such a manner that the voltage regulator operates in a stable manner over the entire load range.

There are a large number of publications in which these and other possibilities for stabilizing voltage regulators are described. Reference is made, for example, to:

a) Thomas M. Frederiksen: "A Monolithic High-Power Series Voltage Regulator", IEEE Journal of Solid-State Circuits, December 1968, page 380 ff.;

b) Gabriel A. Rincon-Mora et al.: "A Low-Voltage, Low Quiescent Current, Low Drop-Out Regulator", IEEE Journal of Solid-State Circuits, Vol. 33, No. 1, January 1998, pages 36 ff.;

c) Gerrit W. den Besten et al.: "Embedded 5 V-to-3.3 V Voltage Regulator for Supplying Digital ICs in 3.3 V CMOS Technology", IEEE Journal of Solid-State Circuits, Vol. 33, No. 7, July 1998, page 956 ff; and d) the other references mentioned therein.

Among the known methods for stabilizing voltage regulators, there is none which is simple to configure and implement and can guarantee reliable stabilization with little intrinsic power requirement under all circumstances.

This applies not only to the series voltage regulator described above but also to so-called low drop output (LDO) regulators which have a common-source PMOS transistor as the driving transistor.

SUMMARY OF THE INVENTION

It is accordingly an object of the invention to provide a voltage regulator which overcomes the above-mentioned disadvantages of the prior art devices of this general type, in which it can guarantee reliable stabilization under all circumstances with minimum intrinsic power requirement and, in addition, is simple to configure and implement.

With the foregoing and other objects in view there is provided, in accordance with the invention, a voltage regulator. The voltage regulator contains a transistor and an output supplying an output voltage that depends on a drive to the transistor. The output is connected to the transistor. A stabilizing circuit is connected to the transistor for changing a current flowing through the transistor.

The voltage regulator according to the invention is distinguished by the fact that it contains a stabilization circuit that can change the current flowing through the transistor.

The stabilization circuit can ensure that the current flowing through the transistor is increased in phases, specifically only in phases in which it would be too small for guaranteeing stable operation of the voltage regulator.

This dispenses with the necessity of having a high shunt current flowing permanently through the transistor. The voltage regulator can be constructed in such a manner that the shunt current flowing through the transistor is very low in phases in which it is not increased by the stabilization circuit, as a result of which the current flowing through the transistor is only slightly higher with large loads than the current drawn by the load.

This has the positive effect that the transistor can be dimensioned in sole dependence on the maximum load, that is to say it does not have to be made larger for reasons of the stability of the voltage regulator. In addition, the voltage regulator according to the invention has a lower intrinsic power requirement because, of course, the additional shunt current is only caused to flow in particular phases.

Moreover, the stabilization circuit can be simply configured and implemented and can be matched without problems to the respective circumstances. In addition, it can be used essentially unchanged in all types of voltage regulators, the output voltage of which depends on the drive to a transistor.

In accordance with an added feature of the invention, the current flowing through the transistor is changed by changing a load driven by the transistor. The load driven by the transistor is changed by reconfiguring the voltage regulator. The stabilization circuit has a switch coupled to the transistor, and the reconfiguration is effected by opening or closing the switch, and through the switch the transistor can be connected to a component acting as a load element or a current sink.

In accordance with an additional feature of the invention, the stabilization circuit has a component disposed in a circuit branch containing the transistor. The current flowing through the transistor is changed by changing a drive to the component.

In accordance with another feature of the invention, the component is a second transistor connected in series with the transistor. The current flowing through the transistor is changed by changing the drive to the second transistor.

In accordance with a further feature of the invention, the stabilizing circuit has a third transistor interconnected with the second transistor to form a current mirror. A current flowing through the second transistor depends on a current flowing through the third transistor.

In accordance with a further added feature of the invention, the stabilization circuit initiates a change in the current flowing through the transistor when and as long as the current flowing through the transistor has a magnitude at which stable operation of the voltage regulator cannot be guaranteed.

In accordance with a further additional feature of the invention, the stabilizing circuit does not change the current flowing through the transistor when and as long as the current flowing through the transistor has a magnitude at which stable operation of the voltage regulator is guaranteed.

In accordance with another further feature of the invention, the stabilization circuit has a reference current generator outputting a reference current, and the stabilization circuit generates a further current. A magnitude of the further current is a measure of the current flowing through the transistor and changes the current flowing through the transistor when the further current or an additional current depending on the further current is less than the reference current.

In accordance with another added feature of the invention, the stabilization circuit has a fourth transistor driven like the transistor and generates the further current. The fourth transistor is dimensioned to be smaller than the transistor. The stabilization circuit ensures that the fourth transistor is operated at a same operating point as the first transistor. The stabilization circuit has a fifth transistor connected in series with the fourth transistor. The stabilization circuit has a sixth transistor interconnected with the fifth transistor to form a further current mirror. The sixth transistor has a source terminal receiving the reference current, and the source terminal of the sixth transistor is further connected to a primary transistor of the current mirror.

In accordance with a concomitant feature of the invention, the current flowing through the transistor is changed via a hysteresis loop.

Other features which are considered as characteristic for the invention are set forth in the appended claims.

Although the invention is illustrated and described herein as embodied in a voltage regulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The voltage regulators described in the text that follows are direct voltage regulators. However, it should be pointed out even at this point that the characteristic features of the voltage regulators described in the text which follows can also be used in voltage regulators for voltages varying with time.

Figure 1:
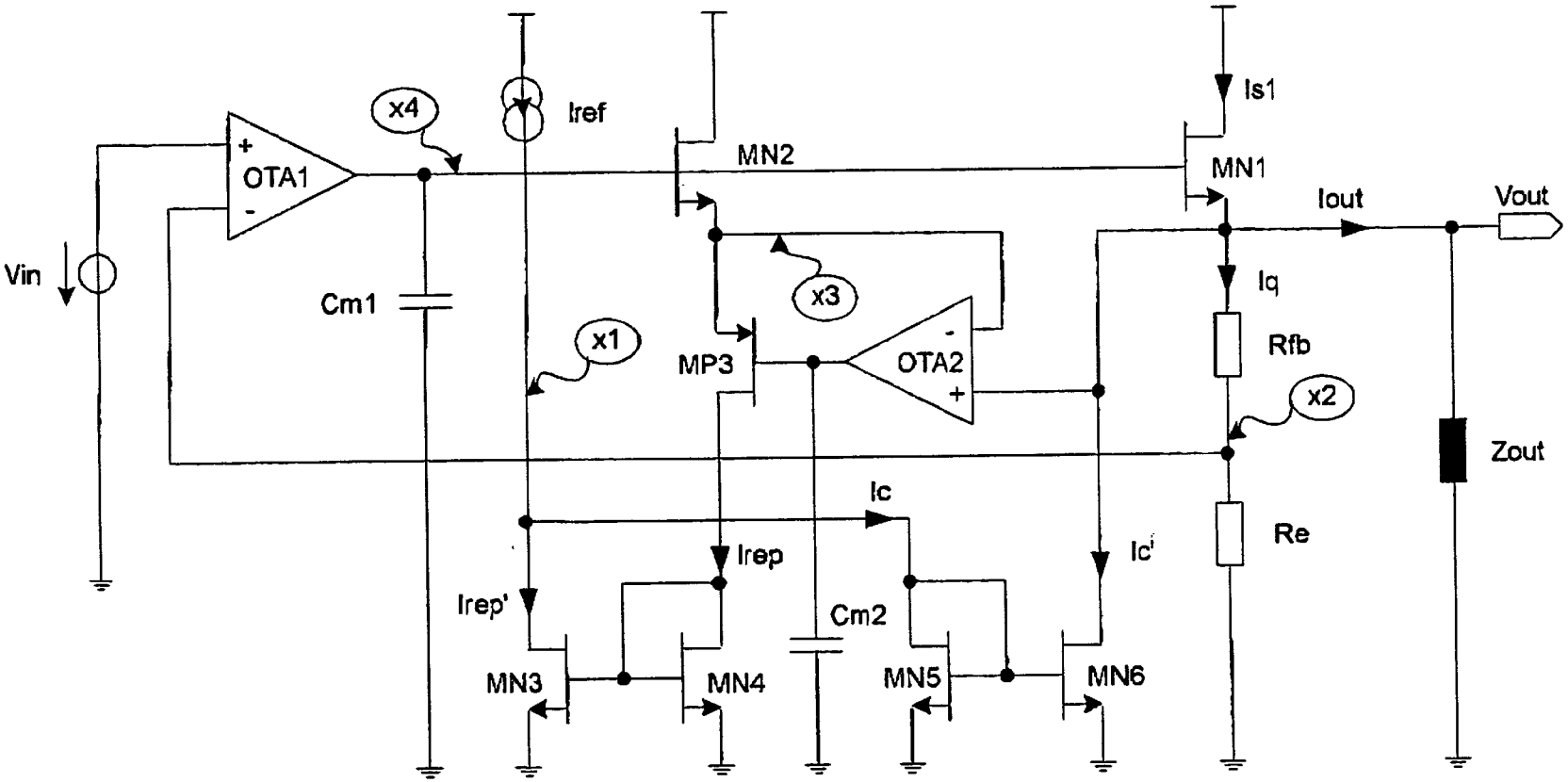
FIG. 1 is a schematic diagram of a series voltage regulator with a stabilization circuit according to the invention.

Referring now to the figures of the drawing in detail and first, particularly, to FIG. 1 thereof, there is shown a configuration which contains a particularly stabilized voltage regulator and the load impedance Zout connected thereto.

Figure 5:
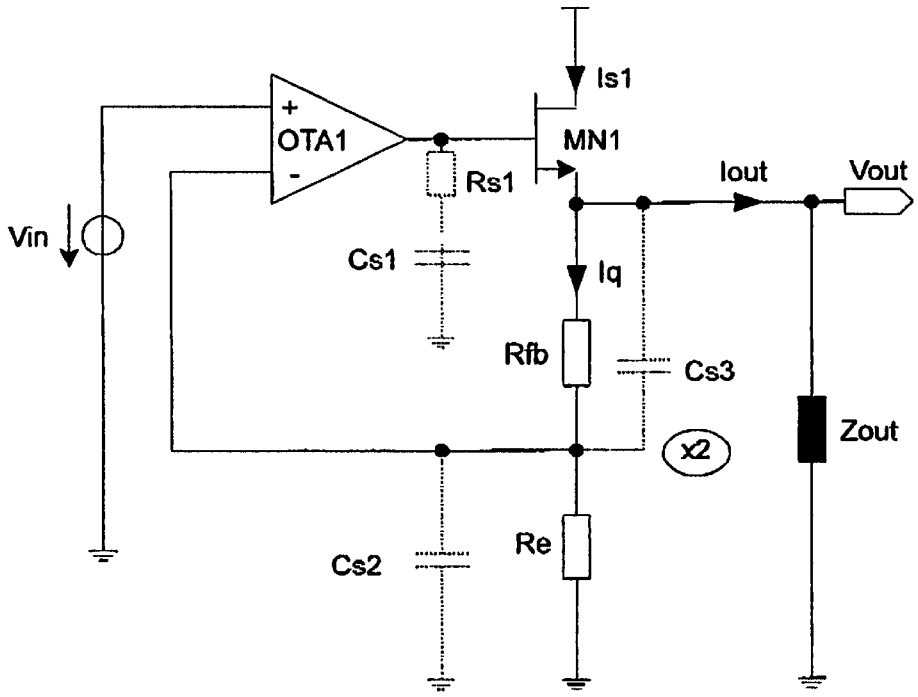
FIG. 5 Prior Art
FIG. 5 is a schematic diagram of a conventional series voltage regulator according to the prior art.

The voltage regulator is a series voltage regulator which, like the voltage regulator shown in FIG. 5 and described initially with reference thereto, contains the differential amplifier (a differential transconductance amplifier) OTA1, the NMOS transistor MN1, the first resistor Rfb and the second resistor Re which are also interconnected and cooperate as in the voltage regulator shown in FIG. 5. The voltage regulator shown in FIG. 1 additionally contains a stabilization circuit that, however, is constructed and operates completely differently from the elements Rs1, Cs1, Cs2 and Cs3 used for stabilization of the voltage regulator according to FIG. 5.

The stabilization circuit consists of a second differential amplifier (a second differential transconductance amplifier) OTA2, NMOS transistors MN2, MN3, MN4, MN5 and MN6, and a PMOS transistor MP3.

To a drain terminal of the transistor MN2, a supply voltage supplying the voltage regulator with power is applied, its gate terminal is connected to the output terminal of the first transconductance amplifier OTA1, and its source terminal is connected to a node x3.

A source terminal of the transistor MP3 is connected to the node x3, its gate terminal is connected to the output terminal of the second transconductance amplifier OTA2, and its drain terminal is connected to the source terminal of the transistor MN4.

The transconductance amplifier OTA2 has two input terminals, one of which is supplied with the voltage occurring at the node x3 and the other of which is supplied with the voltage Vout. The transconductance amplifier OTA2 forms a difference between these voltages and outputs it to a gate terminal of the transistor MP3.

The transistor MN4 (the source of which is connected to ground) is interconnected with the transistor MN3 to form a current mirror, a current Irep flowing through the transistor MN4 causes a current Irep' to flow through the transistor MN3.

A drain terminal of the transistor MN3 (the source of which is also connected to ground) is connected to a node x1. The node x1 is also connected to a reference current source outputting a current Iref and to the drain terminal of transistor MN5.

The transistor MN5 (the source of which is connected to ground) is interconnected with the transistor MN6 to form a current mirror, a current Ic flowing through the transistor MN5 causing a current Ic' to flow through the transistor MN6.

A drain terminal of the transistor MN6 (the source of which is also connected to ground) is connected to the drain terminal of transistor MN1. The transistor MN6 represents for the transistor MN1 an additional load by which the magnitude of the current Is1 flowing through the transistor MN1 can be changed, the drive to the transistor MN1 remaining the same.

Through the transistor MN1, a current flows which corresponds to the sum of the currents Ic', Iq and Iout. Ic' being the current flowing through the transistor MN6, Iq being the current flowing through the voltage divider Rfb, Re, and Iout being the current flowing through the load Zout.

The transconductance amplifier OTA2 and the transistor MP3 ensure that at the source terminal of the transistor MN2 (at node x3), the same potential occurs as at the source terminal of transistor MN1, i.e. that the potential Vout also occurs at node x3. Simplified, the configuration of the transconductance amplifier OTA2 and the transistor MP3 can be considered to be a voltage follower that generates a replica of the output voltage Vout at the node x3. With respect to voltage, transistors MN1 and MN2 are thus at the same operating point, which improves the tracking of the two transistors with respect to one another.

For this reason, and because the gate of the transistor MN2 is driven by the same signal as the gate of the transistor MN1, a current flows through the transistor MN2 which is specifically related to the current flowing through the transistor MN1. The transistor is preferably constructed to be very much weaker than the transistor MN1 so that the current Irep flowing through the transistor MN2 is very much smaller than the current Ic'+Iq+Iout flowing through the transistor MN1. The transistor MN2 thus produces a replica current Irep to the current Ic'+Iq+Iout flowing through the transistor MN1.

The current Irep flowing through the transistor MN2 also flows through the transistor MP3 and the transistor MN4. The current Irep flowing through the transistor MN4 has the effect that a current Irep', which is specifically related to the current Irep, flows through the transistor MN3.

If the current Irep' is greater than or equal to the magnitude of the current Iref, the node x1 is pulled to ground potential, as a result of which the current Ic flowing from node x1 to the source terminal of the transistor MN5 and thus also the mirrored current Ic' become 0 and no additional shunt current flows through the transistor MN1. This is the case when the load impedance Zout is small enough, i.e. the load current Iout is large enough.

If, on the other hand, the current Irep' is less than the current Iref, a current Ic corresponding to the difference between Irep' and Iref flows from the node x1 through the transistor MN5. The current Ic flowing through the transistor MN5 has the effect that the current Ic', which is specifically related to the current Ic, flows through the transistor MN6. As a result, an additional shunt current Ic' flows through the transistor MN1. This is the case if the load impedance Zout is large, i.e. the load current Iout is small.

The stabilization circuit can thus have the effect that an additional shunt current Ic' flows through the transistor MN1 if the sum of the currents Iout and Iq is small, and that no additional shunt current Ic' flows through the transistor MN1 if the sum of the currents Iout and Iq is large or, more precisely, is large enough for guaranteeing stable operation of the voltage regulator.

In addition, the voltage regulator according to FIG. 1 also contains capacitors Cm1 and Cm2 via which the output terminals of the transconductance amplifiers OTA1 and OTA2 are connected to ground and which are used for frequency compensation of the transconductance amplifiers OTA1 and OTA2.

Figure 2:
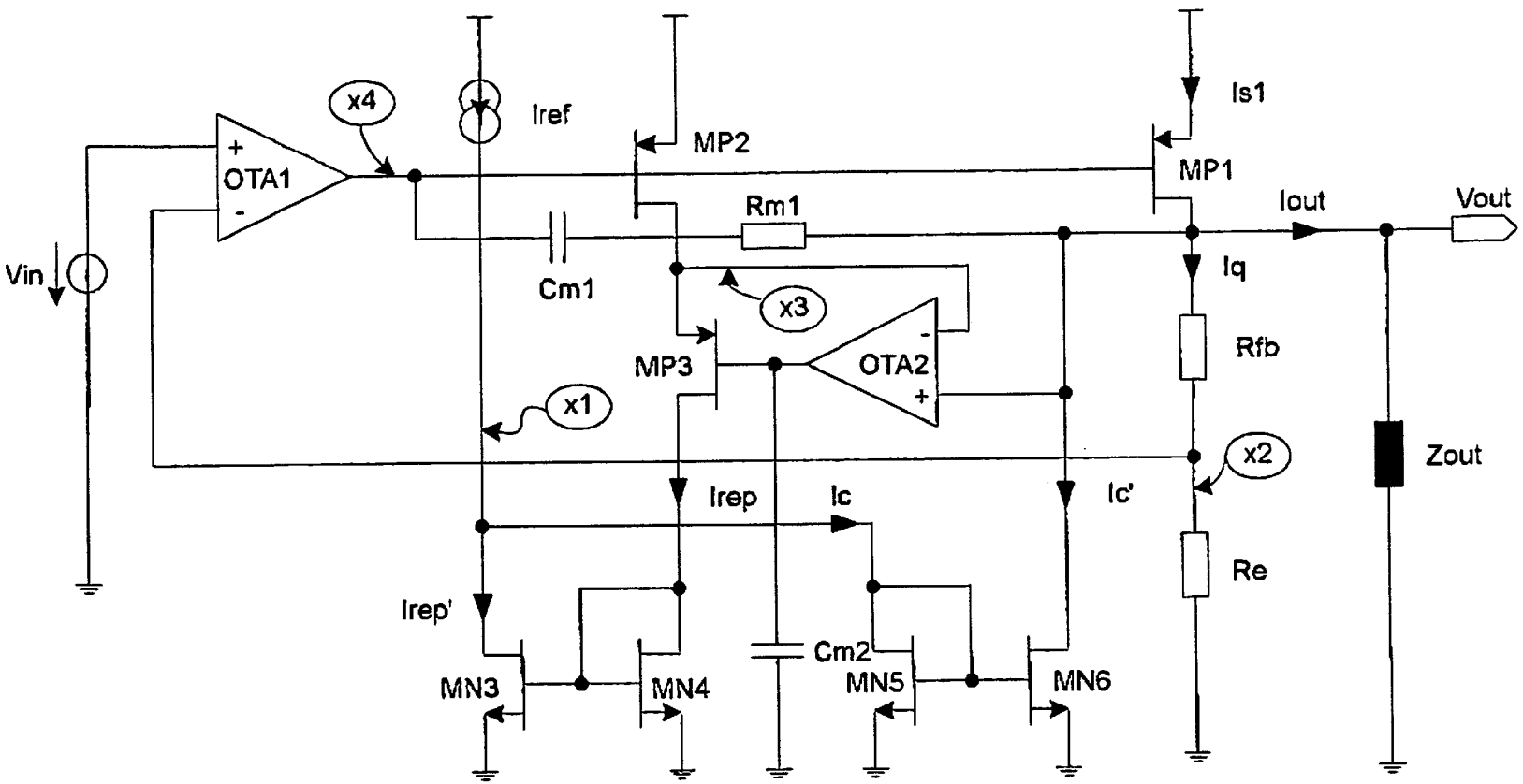
FIG. 2 is a schematic diagram of a low drop output regulator with the stabilization circuit.

Essentially the same stabilization circuit can be used in a so-called low drop output regulator. FIG. 2 shows the low drop output regulator with a stabilization circuit that corresponds to the stabilization circuit described above.

The configuration shown in FIG. 2 differs from the configuration shown in FIG. 1 only in that instead of the common-drain NMOS driver transistor MN1, a common-source PMOS driver transistor MP1 is used, and the frequency compensation of the first transconductance amplifier OTA1 is effected by a series circuit of the capacitor Cm1 and a resistor Rm1 (key word: Miller compensation or pole splitting, respectively) disposed between the output terminal of the transconductance amplifier OTA1 and the output terminal of the voltage regulator (the drain terminal of transistor MP1).

In the text that follows, the operation of the configurations shown in FIGS. 1 and 2 and their dimensioning will be described again in greater detail.

Neglecting non-ideal features, the output voltage Vout of the voltage regulator is obtained as:

$$\mathrm{Vout} \cong \mathrm{Vin} * \frac{Rfb + \mathrm{Re}}{\mathrm{Re}} \tag{1.3}$$

When the load changes, the output voltage Vout changes. The transconductance amplifier OTA1 (also called error amplifier) corrects the gate-source voltage of the transistor MN1 (MP1) until the voltage has returned to the nominal value at the output.

If the load current Iout is above a lower threshold Ioutmin, the current Ic' is equal to 0 and the following holds true for the sum of the currents at the pickup point of Vout, called node Vout in the text which follows:

$$Iout + Iq - Is1 = 0 \tag{1.4}$$

Neglecting non-ideal features (mismatch etc.), the current flowing through the transistor MN2 is obtained as:

$$Irep \cong \frac{\beta n_{MN2} * W_{MN2} * L_{MN1}}{Bn_{MN1} * W_{MN1} * L_{MN2}} * Is1 \tag{1.5}$$

where W is a width of the transistor mentioned in the respective index, L is a length of the transistor mentioned in the respective index, and β is the process constant of the transistor and transistor type mentioned in the respective index. To simplify, it is assumed that the process constants are identical for transistors of the same type, and they will thus not be mentioned in the text that follows unless required.

The current Is1 is minimum when Iout and Ic' are equal to 0 and is $$\begin{aligned} Is1_{\min} &= \frac{\mathrm{Vout}}{Rfb + \mathrm{Re}} \\ &= \mathrm{Vin} * \frac{(Rfb + \mathrm{Re})}{\mathrm{Re}} * \frac{1}{(Rfb + \mathrm{Re})} \\ &= \frac{\mathrm{Vin}}{\mathrm{Re}} \end{aligned} \tag{1.6}$$

The current Irep occurring with Is1=Is1min is (see equations 1.5 and 1.6)

$$Irep_{\min} = \frac{W_{MN2} * L_{MN1}}{W_{MN1} * L_{MN2}} * \frac{\mathrm{Vin}}{\mathrm{Re}} \tag{1.7}$$

It also holds true that $$\mathrm{Iref} - \mathrm{Ic} - \mathrm{Irep}' = 0 \tag{1.8}$$

$$Irep' \cong \frac{W_{MN3} * L_{MN4}}{W_{MN4} * L_{MN3}} \tag{1.9}$$

$$Ic' \cong \frac{W_{MN6} * L_{MN5}}{W_{MN5} * L_{MN6}} * Ic \tag{1.10}$$

If the load current Iout decreases, starting from a maximum value, the current Is1 in the transistor MN1 (MP1) drops, as does the current in the transistor MN2, as well. If the current Irep' becomes less than Iref, the potential at node x1 rises. If the voltage V(x1) occurring at node x1 becomes greater than Vthn (threshold voltage of transistor MN5), the current Ic flows through the transistor MN5, and the current Ic' flows through the transistor MN6. At this instant, the current in the node Vout is composed as follows:

$$Iout + Iq + Ic' - Is1 = 0 \tag{1.11}$$

From equations 1.3 to 1.11, the following is obtained $$Irep' \cong \left[\left(\frac{W_{MN2} * L_{MN1}}{W_{MN1} * L_{MN2}}\right) * \left(\mathrm{Iout} + \frac{\mathrm{Vin}}{\mathrm{Re}}\right)\right] * \frac{W_{MN3} * L_{MN4}}{W_{MN4} * L_{MN3}} \tag{1.12}$$

$$Ic' \cong \left(Iref - \left[\left(\frac{W_{MN2} * L_{MN1}}{W_{MN1} * L_{MN2}}\right) * \left(\mathrm{Iout} + \frac{\mathrm{Vin}}{\mathrm{Re}}\right)\right] * \frac{W_{MN3} * L_{MN4}}{W_{MN4} * L_{MN3}}\right) * \frac{W_{MN6} * L_{MN5}}{W_{MN5} * L_{MN6}} \tag{1.13}$$

This then produces the conditions for current Ic':

$$\text{for Iout} < Iref * \frac{W_{MN1} * L_{MN2}}{W_{MN2} * L_{MN1}} * \frac{W_{MN4} * L_{MN3}}{W_{MN3} * L_{MN4}} - Iq \Rightarrow Ic' > 0 \tag{1.14a}$$

$$\text{for Iout} > Iref * \frac{W_{MN1} * L_{MN2}}{W_{MN2} * L_{MN1}} * \frac{W_{MN4} * L_{MN3}}{W_{MN3} * L_{MN4}} - Iq \Rightarrow Ic' = 0 \tag{1.14b}$$

Using equation 1.14a and 1.14b, the circuit can now be dimensioned, taking into consideration the transconductance of the transistor MN1 (MP1), which is necessary for stability.

First, a description is given of how the necessary current Ic' can be determined from the requirement for stability and thus a minimum phase margin. The assumption is that the transconductance amplifier OTA1 has a simplified transfer function with a dominant pole. Parasitic poles and zeroes will not be taken into consideration.

The Laplace transfer function in the frequency range of the transconductance amplifier is then $$A_{OTA1}(s) \cong \frac{1}{1 + s * C_{m1} * 1/gm_{OTA1}} \tag{1.15}$$

and its pole frequency is $$f_{p1} = \frac{1}{2 * \pi * C_{m1} * 1/gm_{OTA1}} \tag{1.16}$$

where $gm_{OTA1}$, designates the transconductance of the transconductance amplifier OTA1.

For the rest of the analysis, the frequency response compensation circuit consisting of Cm1 and Rm1 will be ignored initially. The following determinations can be made for the transconductance amplifier OTA1 and the output stage:

$$R1 = \frac{1}{gdsp} + \frac{1}{gdsn} \tag{1.17}$$

$$C1 = Cgs_{MP1} + Cgd_{MP1} * (1 + |Av11_{MP1}|) \tag{1.18}$$

$$R2 = \frac{1}{gds_{MP1}} \| Rout \| Rmin;\ Rmin = \frac{Vin}{Is_{min}} \tag{1.19}$$

$$C2 = C1 + Cgd_{MP1} * (1 + |Av11_{MP1}|) \tag{1.20}$$

$$Av11 = gm_{MP1} * \left(\frac{1}{gds_{MP1}} \| Rmin\right) \tag{1.21}$$

where

- R1 is an output resistance of the transconductance amplifier OTA1,
- gdsp is an output conductance of a P-channel MOS transistor,
- gdsn is an output conductance of an N-channel MOS transistor,
- C1 is a sum of the load capacitances at the node X4 (OTA1 output),
- $Cgs_{MP1}$ is a gate-source capacitance of transistor MP1,
- $Cgd_{MP1}$ is a gate-drain capacitance of transistor MP1,
- Av11 is a direct-voltage gain of the output stage (e.g. transistor MP1),
- R2 is an output resistance of the driver configuration,
- $gds_{MP1}$ is an output conductance of the transistor MP1,
- Rout is a purely resistive load impedance at the node Vout,
- Rmin is a most minimum aggregate resistivity of Rfb and Re as auxiliary quantity for dimensioning,
- C2 is a transformed load capacitance for calculating the second pole fp2', and
- $gm_{MP1}$ is the transconductance of the output transistor MP1.

For series-shunt feedback configurations such as the voltage regulators shown in FIGS. 1 and 2, two poles can be specified, neglecting the frequency compensation:

$$fp1' = \frac{1}{2 * \pi * R1 * C1} \tag{1.22}$$

-continued $$fp2' = \frac{1}{2 * \pi * R2 * C2} \tag{1.23}$$

From general stability theory, it is known that fp2'>>fp1' must apply in order to guarantee a sufficiently large phase margin. If the load current Iout then tends toward 0 (if R1 tends toward infinity), the pole fp2' migrates toward the pole fp1'. The phase margin decreases, and the system becomes unstable.

Taking into consideration the frequency response compensation, the poles are obtained as follows:

$$fc1 = \frac{1}{2 * \pi * R1 * [Cgs_{MP1} + (Cgd_{MP1} + C_{m1}) * [1 + |Av11|]]} \tag{1.24}$$

$$fc2 = \frac{1}{2 * \pi * R2 * (C1 + Cm1 + Cgs_{MP1})} \tag{1.25}$$

From equations 1.22 and 1.23, the total transfer function in the frequency plane can then be represented as a second-order system.

$$Avtot(s) = \frac{Vout(s)}{Vin(s)} = \frac{gm_{OTA1} * R1 * Av11}{(1 + s * f/fc1) * (1 + s * f/fc2)} \tag{1.26}$$

Assuming that f1c<<f2c and considering that the absolute value of the gain is |Avtot(s)|=1 at a frequency of fu, the following is obtained:

$$|Avtot(s)| = \frac{gm_{OTA1} * R1 * Av11}{\sqrt{1 + (f/fc1)^2}} = 1 \tag{1.27}$$

$$fu = fc1 * gm_{OTA1} * R1 * Av11 \tag{1.27a}$$

Assuming that the load capacitance, the maximum load current and minimum load current are known, either the compensation capacitance Cm1 and/or the minimum shunt current Is1 in the transistor MP1/MN1 can now be calculated. To guarantee stability, the following determination should apply:

$$fc2 > 10 * fu \Rightarrow fc2 > 10 * fc1 * gm_{OTA1} * R1 * Av11 \tag{1.28}$$

Thus, the following relationships are obtained for Rmin and for Cm1 (taking into consideration equation 1.25):

$$Rmin = \frac{Vin}{Iq + Ic'} = 1 \Big/ \left[2\pi * 10 fc1 * gm_{OTA1} * R1 * Av11 * (C1 + Cm1 + Cgd_{MP1}) - gds_{MP1} - \frac{1}{Rout}\right] \tag{1.29}$$

Using equations 1.29, 1.14 and 1.15, the circuit can now be appropriately dimensioned. A structure and a value for the transconductance $gm_{OTA1}$ of OTA1 must be determined at the beginning of the design process. This can be done from an input for the bandwidth of the OTA in accordance with equation 1.16. For the gain of the driving transistor, the assumption can be made that the minimum current Iq flows as Is1. The circuit is thus provided with an appropriate stability margin.

As can be seen from the above equations, they were created partially for the low drop output voltage regulator shown in FIG. 2. The relationships derived in this way can be transferred to the series voltage regulator shown in FIG. 1, taking into consideration the following formulae:

$$Av12 = \frac{gm_{MN1} * Rout}{gm_{MN1} * Rout + 1} \tag{1.30}$$

$$R2' = \frac{1}{gm_{MN1} + gmb_{MN1} + gds_{MN1}} \| Rout \| Rmin \tag{1.31}$$

$$C2' = C1 + Cdb1 \tag{1.32}$$

$$C1' = Cgs1 * Cgd1 * \left(1 + \left|\frac{gm_{MN1} * Rout}{gm_{MN1} * Rout + 1}\right|\right) \tag{1.33}$$

$$fc1' = \frac{1}{2 * \pi * R1 * [Cgs_{MN1} + (Cgd_{MN1} + Cm1) * [1 + |Av12|]]} \tag{1.34}$$

With the same assumptions as for the LDO configuration, an Rmin' is obtained for the series voltage regulator:

$$Rmin' = \frac{Vin}{Iq + Ic'} = 1 \Big/ \left[2\pi * 10 fcl' * gm_{OTA1} * R1 * Av12 * (C1 + Cm1 + Cgs_{MN1}) - gm_{MN1} + gmb_{MN1} + gds_{MN1} - \frac{1}{Rout}\right] \tag{1.35}$$

Using equations 1.35 and 1.29, the minimum shunt current which must flow through the output transistor MN1 and MP1, respectively, in order to guarantee stability with a given load capacitance, can then be determined for the configurations shown in FIGS. 1 and 2. It should be pointed out again that the resistance Rmin (Rmin') is used as auxiliary quantity for the design process. The current through an assumed resistance Rmin (Rmin') can then be divided correspondingly between the current Iq through voltage divider Rfb and Re and current Ic'. The circuit can thus be completely dimensioned.

Figure 6:
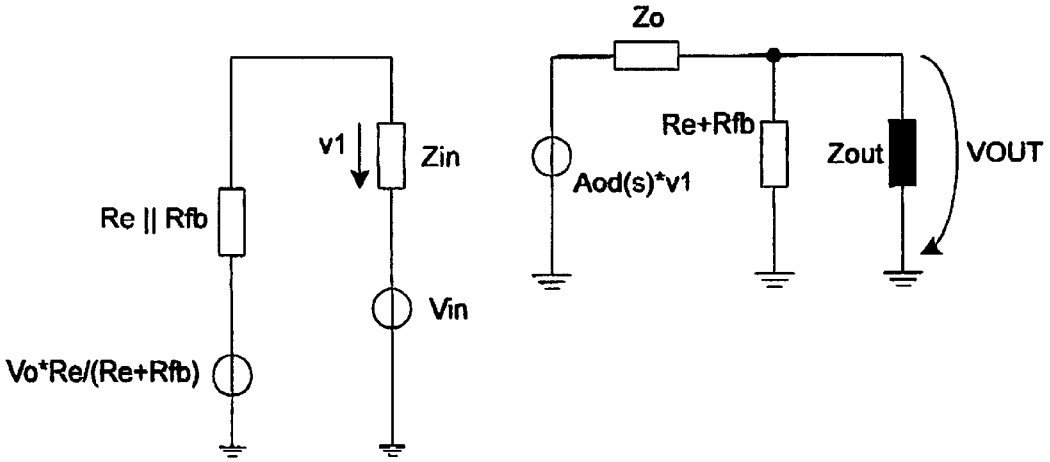
FIG. 6 Prior Art
FIG. 6 shows a simplified small-signal equivalent circuit of the configuration shown in FIG. 5.

To check the mathematical results, the transfer function in the frequency domain of the closed control loop can be derived from the small-signal equivalent circuit shown in FIG. 6.

$$Gav_{ac}(s) = 20 * \log\left(\frac{\frac{Zin(s)}{Zin(s) + Re \| Rfb} * Avtot(s) * \frac{(Re + Rfb) \| C1}{(Re + Rfb) \| C1 + Rout}}{1 + \frac{Re}{Re + Rfb} * \left(\frac{Zin(s)}{Zin(s) + Re \| Rfb} * Avtot(s) * \frac{(Re + Rfb) \| C1}{(Re + Rfb) \| C1 + Rout}\right)}\right) \tag{1.36}$$

$$Gav_{dc} \cong 20 * \log\left(\frac{Re + Rf}{Re}\right) \tag{1.37}$$

If the transfer function has a peak in the frequency domain with respect to the expected DC gain, instability or at least ringing must be assumed.

Using the abovementioned equations, the circuit can be configured appropriately.

Figure 3:
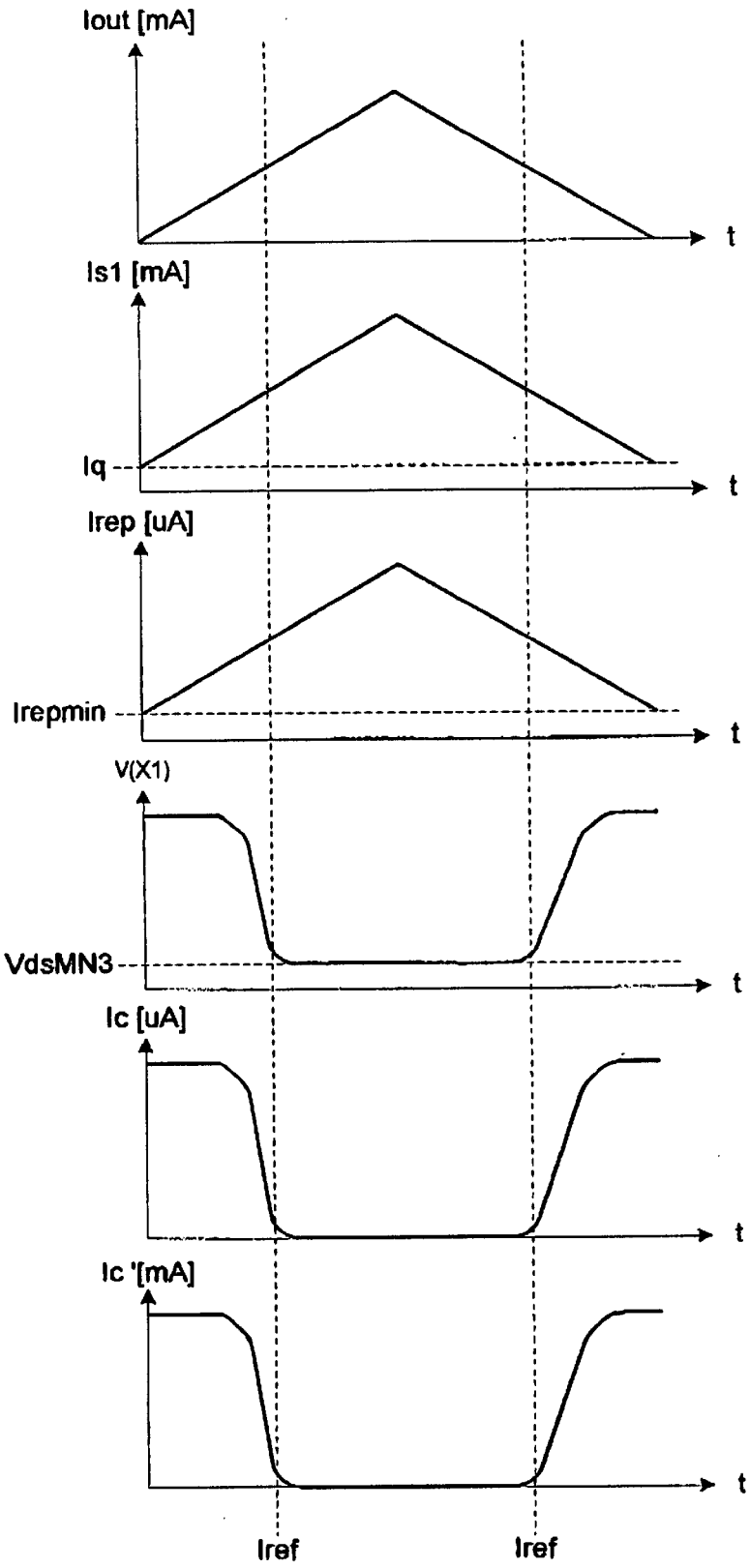
FIG. 3 is a graph showing variations with time of selected currents and voltages in the configuration shown in FIG. 1.

FIG. 3 shows by way of example current and voltage variations in a properly dimensioned voltage regulator with a stabilizing circuit of the type described above.

Figure 4:
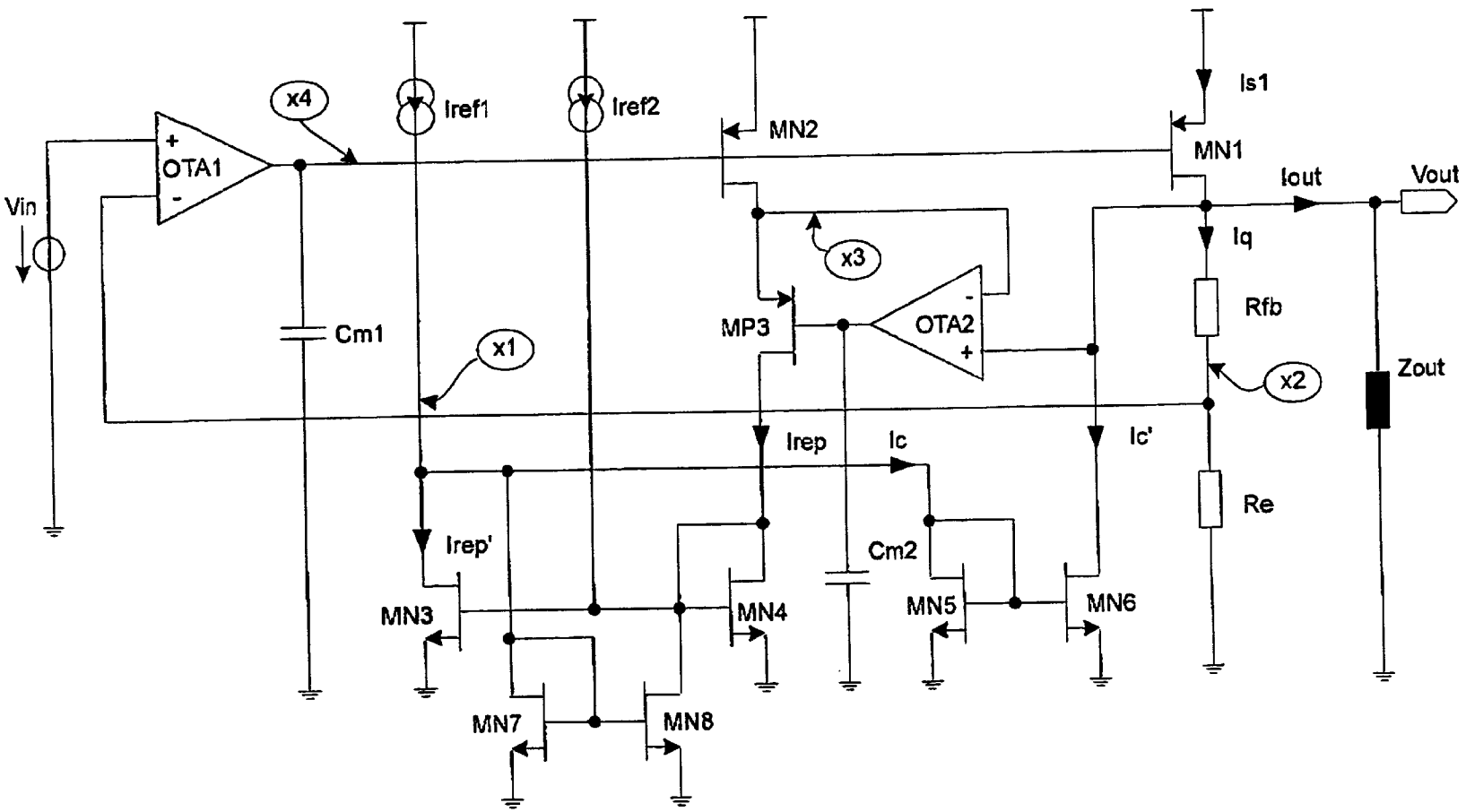
FIG. 4 is a schematic diagram of the series voltage regulator with a modified stabilization circuit.

FIG. 4 shows a stabilization circuit in which a hysteresis is provided for switching the additional shunt current Ic' on and off.

The configuration shown in FIG. 4 corresponds closely to the configuration shown in FIG. 1; elements designated with the same reference symbols are identical or corresponding elements.

The stabilization circuit shown in FIG. 4 additionally contains NMOS transistors MN7 and MN8 and a current source supplying a reference current Iref2.

Transistors MN7 and MN8 are interconnected to form a current mirror, a drain terminal of the transistor MN7 and gate terminals of the transistors MN7 and MN8 are connected to node x1. The drain terminal of the transistor MN8 is connected to the drain terminal of the transistor MN4, the gate terminals of transistors MN3 and MN4 and the current source supplying the reference current Iref2, and the source terminals of the transistors MN7 and MN8 are connected to ground.

The additional measures have the result that the threshold value, below which Irep must drop for the additional shunt current Ic' to flow, is lower than the threshold value which must be exceeded by Irep for no additional shunt current Ic' to flow.

The hysteresis is characterized by:

$$I_{hys} = \left(\frac{W_{MN4} * L_{MN3}}{W_{MN3} * L_{MN4}} - \frac{W_{MN7} * L_{MN8}}{W_{MN8} * L_{MN7}}\right) * Iref1 \tag{1.38}$$

The stabilization circuits described can be modified in many different ways.

For example, the magnitude of the additional shunt current Ic' could be set in such a manner that the current flowing through the transistor MN1 and MP1, respectively, is in each case just large enough, i.e. not much greater than required, for guaranteeing stable operation of the voltage regulator.

The magnitude of the additional shunt current Ic' could also be made variable in a number of steps.

The shunt current flowing through the transistor could also be made large as a standard measure, and the stabilization circuit could ensure that the shunt current is reduced when the magnitude of the current flowing through the transistor (or a current depending on the magnitude of this current) exceeds a particular threshold value.

Independently of this, the current flowing through the transistor MN1 or MP1, respectively, can be changed by reconfiguring the configuration, for example by opening, closing or switching over switches via which the transistor can be connected to components or current sinks acting as load elements. Irrespective of the details of the practical implementation, the stabilization circuits of the voltage regulators described can be simply configured and implemented and can guarantee stabilization which is reliable under all circumstances with minimum intrinsic power requirement of the voltage regulators.

I claim:

1. A voltage regulator, comprising:

a first transistor;

an output supplying an output voltage which depends on a drive to said first transistor, said output connected to said first transistor; and a stabilizing circuit connected to said first transistor for changing a current flowing through said first transistor;

said stabilizing circuit including a transistor; and during operation, said first transistor being operated with a channel current and said transistor of said stabilizing circuit being operated with a channel current dependent on said channel current of said first transistor.

2. The voltage regulator according to claim 1, wherein the current flowing through said first transistor is changed by changing a load driven by said first transistor.

3. The voltage regulator according to claim 2, wherein the load driven by said first transistor is changed by reconfiguring the voltage regulator.

4. The voltage regulator according to claim 3, wherein said stabilization circuit has a switch coupled to said first transistor, and a reconfiguration is effected by opening or closing said switch, and through said switch said first transistor can be connected to a component acting as one of a load element and a current sink.

5. The voltage regulator according to claim 1, wherein said stabilization circuit has a component disposed in a circuit branch containing said first transistor, and the current flowing through said first transistor is changed by changing a drive to said component.

6. The voltage regulator according to claim 5, wherein said component is a second transistor connected in series with said first transistor, the current flowing through said first transistor is changed by changing the drive to said second transistor.

7. The voltage regulator according to claim 6, wherein said stabilizing circuit has a third transistor interconnected with said second transistor to form a current mirror, and a current flowing through said second transistor depends on a current flowing through said third transistor.

8. The voltage regulator according to claim 7, wherein said stabilization circuit initiates a change in the current flowing through said first transistor when and as long as the current flowing through said first transistor has a magnitude at which stable operation of the voltage regulator cannot be guaranteed.

9. The voltage regulator according to claim 1, wherein said stabilizing circuit does not change the current flowing through said first transistor when and as long as the current flowing through said first transistor has a magnitude at which stable operation of the voltage regulator is guaranteed.

10. The voltage regulator according to claim 8, wherein:

said stabilizing circuit has a reference current generator outputting a reference current;

said stabilizing circuit generates a further current, a magnitude of the further current is a measure of the current flowing through said first transistor and changes the current flowing through said first transistor when the further current or an additional current depending on the further current is less than the reference current.

11. The voltage regulator according to claim 10, wherein said transistor of said stabilizing circuit is driven like said first transistor and generates the further current.

12. The voltage regulator according to claim 11, wherein said transistor of said stabilizing circuit is dimensioned to be smaller than said first transistor.

13. The voltage regulator according to claim 11, wherein said stabilizing circuit ensures that said transistor of said stabilizing circuit is operated at a same operating point as said first transistor.

14. The voltage regulator according to claim 11, wherein:

said transistor of said stabilizing circuit is defined as a fourth transistor;

said stabilizing circuit has a fifth transistor connected in series with said fourth transistor; and said stabilizing circuit has a sixth transistor interconnected with said fifth transistor to form a further current mirror, said sixth transistor having a source terminal receiving the reference current, and the source terminal of the sixth transistor connected to a primary transistor of said current mirror.

15. The voltage regulator according to claim 1, wherein the current flowing through said first transistor is changed via a hysteresis loop.

16. The voltage regulator according to claim 1, wherein said channel current of said transistor of said stabilizing circuit is proportional to said channel current of said first transistor.

17. The voltage regulator according to claim 1, wherein said first transistor has a gate and said transistor of said stabilizing circuit has a gate directly connected to said gate of said first transistor.

* * * * *